United States Patent [19]

Okabe et al.

[11] 4,162,658

[45] Jul. 31, 1979

[54] FLOATING LIQUID-STORAGE TANK HAVING SIDE WALLS OF DOUBLE-HULL CONSTRUCTION

[75] Inventors: Toshimasa Okabe; Hiroyuki Shimada; Toshio Hanano; Naofumi Murao, all of Nagasaki; Kazuyoshi Mori, Tokyo; Hirohisa Tomikawa, Nagasaki; Akira Mizokami, Nagasaki; Yasuyuki Maehara, Nagasaki; Masanori Shuku, Nagasaki, all of Japan

[73] Assignee: Mitsubishi Jukogo Kabushiki Kaisha, Tokyo, Japan

[21] Appl. No.: 850,372

[22] Filed: Nov. 10, 1977

[30] Foreign Application Priority Data

Nov. 25, 1976 [JP] Japan ..... 51/141456

[51] Int. Cl.[2] ..... B63B 25/08

[52] U.S. Cl. ..... 114/74 A

[58] Field of Search ..... 114/74 R, 74 A, 74 T, 114/121, 125; 220/9 R, 428, 426

[56] References Cited

U.S. PATENT DOCUMENTS 860,492 7/1907 Mehrtens ..... 114/125

FOREIGN PATENT DOCUMENTS 1252093 10/1967 Fed. Rep. of Germany ..... 114/74 R 1311097 1/1962 France ..... 114/74 R

*Primary Examiner*—Jesus D. Sotelo

*Attorney, Agent, or Firm*—Sherman Levy

[57] ABSTRACT

A floating liquid-storage tank has side walls of double-hull construction for storing a liquid lighter in specific gravity than water. The double-hull side walls consist of inner and outer hull sections and have watertight partition plates for dividing the hollows of the side walls into upper and lower ballast tanks. The outer hull sections of the upper ballast tanks are built to be resistant to the external water pressure and those of the lower ballast tanks are non-pressure-resistant. Holes through which the water outside can enter the lower ballast tanks are made in the outer hull sections of the lower ballast tanks. The partition plates are horizontally located at or slightly below the level of the intersection of the liquid-pressure distribution line and the external-water-pressure distribution line in the direction of depth of the storage tank in the full loaded condition. The bottom wall of the storage tank has a bottom ballast tank formed integrally with the lower ballast tanks, and the outer hull section of the bottom wall is built to be non-pressure-resistant.

2 Claims, 10 Drawing Figures

FLOATING LIQUID-STORAGE TANK HAVING SIDE WALLS OF DOUBLE-HULL CONSTRUCTION

This invention relates to a floating liquid-storage tank, and more specifically to such a tank of double-hull construction for storing a liquid of a lighter specific gravity than that of water.

Generally, the floating tank of this type is a double-hull structure having inner and outer hulls. The outer hull is commonly built to be watertight and pressure-resistant throughout so that it may function as a secondary barrier and prevent any leak of the liquid out of the tank. This calls for a large quantity of steel for added strength, resulting in a heavy structure at high cost.

The present invention aims at solving these problems, and has for its object to provide a floating liquid-storage tank whose side walls of double-hull construction have outer hull sections the lower parts of which are built to be non-pressure-resistant to economize on steel and reduce the cost of fabrication, and further to prevent any leak of the liquid out of the tank.

The object is realized, in accordance with the invention, by a floating liquid-storage tank having side walls of double-hull construction for storing a liquid lighter in specific gravity than water, characterized in that the double-hull side walls consist of inner and outer hull sections and have watertight partition plates for dividing the hollows of the side walls into upper and lower ballast tanks, the outer hull sections of the upper ballast tanks being built to be resistant to the external water pressure and those of the lower ballast tanks being non-pressure-resistant, and holes through which the water outside can have access to the lower ballast tanks are made in the outer hull sections of the lower ballast tanks, said partition plates being horizontally located at or slightly below the level of the intersection of the liquid-pressure distribution line and the external-water-pressure distribution line in the direction of depth of the storage tank in the full loaded condition.

An embodiment of the floating liquid-storage tank of the invention will now be described with reference to the accompanying drawings, in which:

FIGS. 8 to 20 are fragmentary cross sectional views of the tank illustrating its functions.

Figure 1:
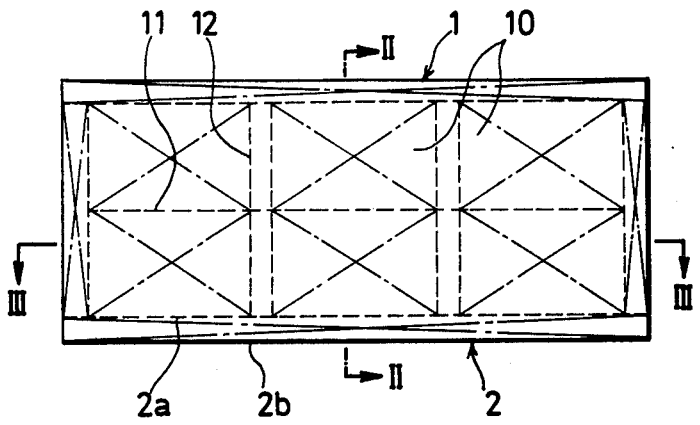
FIG. 1 is a plan view of the storage tank.
Figure 2:
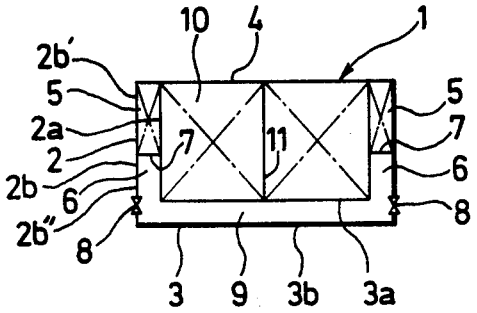
FIG. 2 is a cross sectional view taken along the line II—II of FIG. 1.
Figure 3:
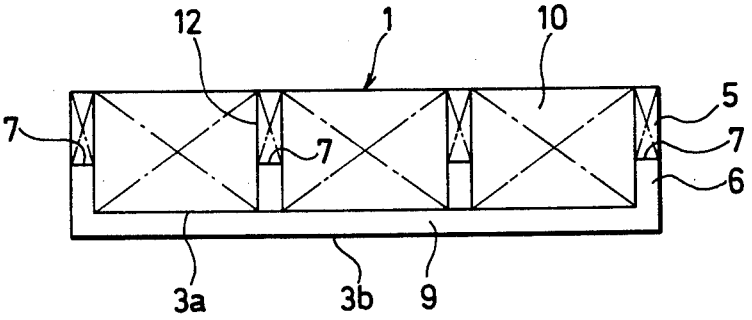
FIG. 3 is a longitudinal sectional view taken along the line III—III of FIG. 1.

As shown in FIGS. 1 to 3, a liquid-storage tank 1 as a floating structure comprises side walls 2 and a bottom wall 3 of double-hull construction, consisting of inner hull sections 2*a*, 3*a* and outer hull sections 2*b*, 3*b*, respectively, and a single-hull top wall 4.

Each side wall 2 is divided into an upper ballast tank and a lower ballast tank 6 by a horizontal watertight partition plate 7. The outer hull section 2*b*′ of the upper ballast tank 5 is constructed to be resistant to external water pressure, but the outer hull section 2*b*″ of the lower ballast tank 6 is a non-pressure-resistant structure. The outer hull section 2*b*″ has a valved hole 8 through which communication is established between the lower ballast tank 6 and the outside. The valved hole 8 is normally open so that outer sea water can always flow into, and flow out of, the tank 6 according to the draft line.

The lower ballast tanks 6 on the both sides are built integrally with a bottom ballast tank 9 formed in the bottom wall 3 of double-hull construction. The outer hull section 3*b* of the bottom wall 3 is of non-pressure-resistant construction.

The space 10 inside the storage tank 1 is defined by the inner hull sections 2*a*, 3*a* and bulkheads 11, 12, which are all of pressure-resistant construction.

Figure 8:
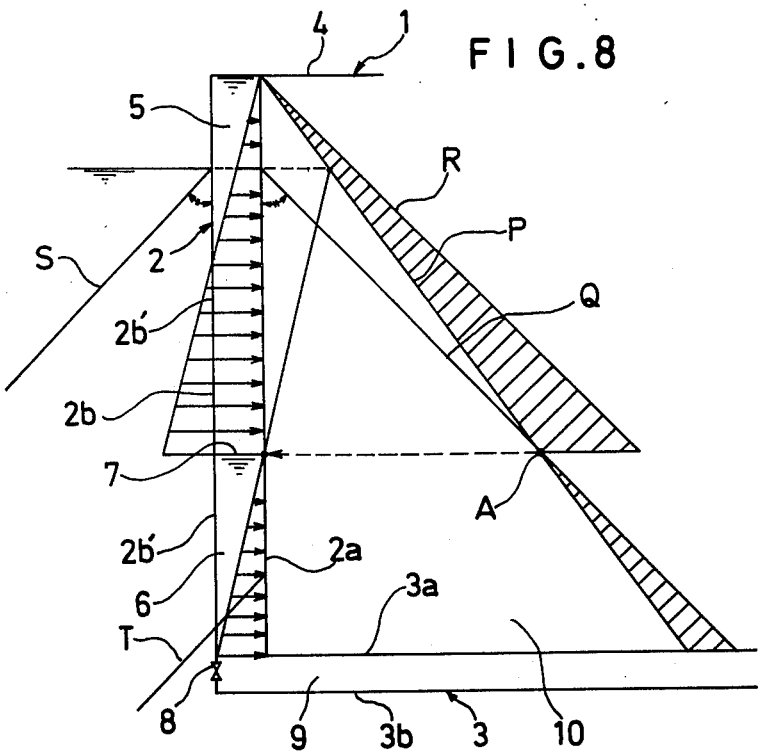

The height at which the partition plates 7 are attached, as better shown in FIG. 8, is chosen to be equal to or slightly below the level of the intersection A of the external-water-pressure distribution line Q and the liquid-pressure distribution line P described in the direction of depth of the tank space 10 filled with a liquid (e.g., petroleum) of a lighter specific gravity than that of water.

Figure 4:
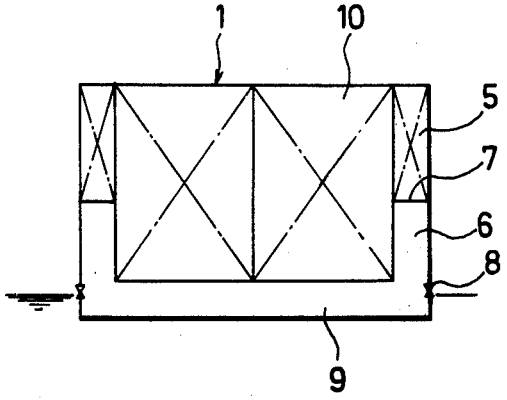
FIGS. 4 through 7 are sequential cross sectional views of the tank in use.
Figure 5:
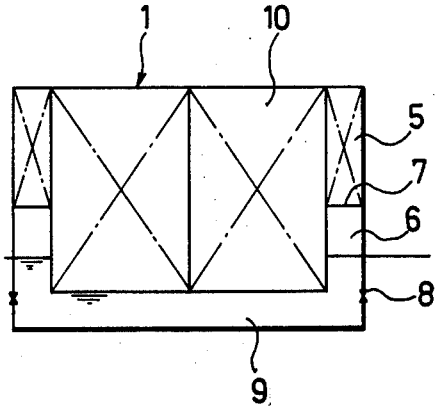
Figure 6:
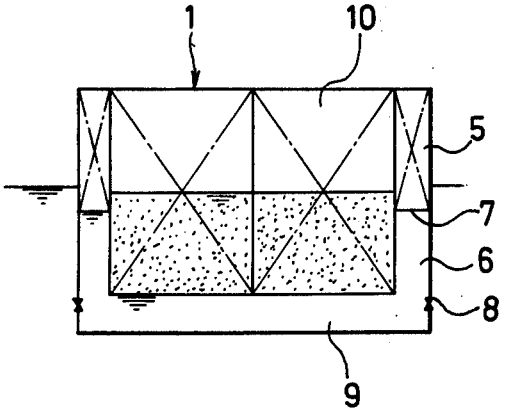
Figure 7:
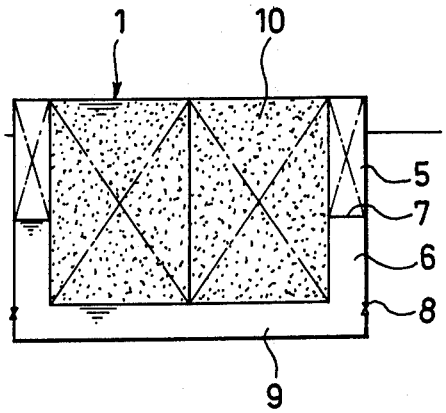

With the construction described above, the floating liquid-storage tank according to this invention is used in varied conditions; light loaded as shown in FIG. 4, ballasted as in FIG. 5, half loaded as in FIG. 6, and full loaded as in FIG. 7.

In the full loaded condition, as is clear from FIG. 8, the inner hull sections 2*a*, 3*a* are subjected to an external water pressure greater than the internal pressure of the tank space 10. In the same figure, the symbol R indicates the water-pressure distribution line in the upper ballast tank 5, S indicates the external-water-pressure distribution line, and T indicates the water-pressure distribution line in the lower ballast tank 6 in the ballasted condition.

Figure 9:
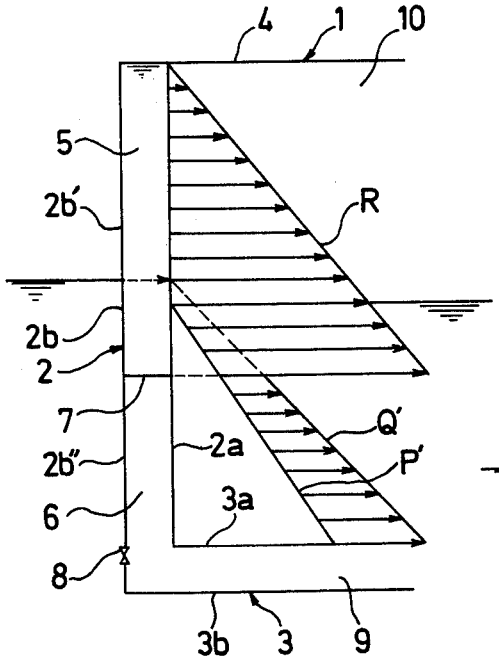

FIG. 9 illustrates the difference between the external and internal pressures applied to the liquid-storage tank in the half loaded condition. The symbol P′ denotes the liquid-pressure distribution line of the tank space 10 half filled with the liquid, and Q′ denotes the external-water-pressure distribution line. The external water pressure is greater when the tank is half loaded as well as when it is fully loaded.

Figure 10:
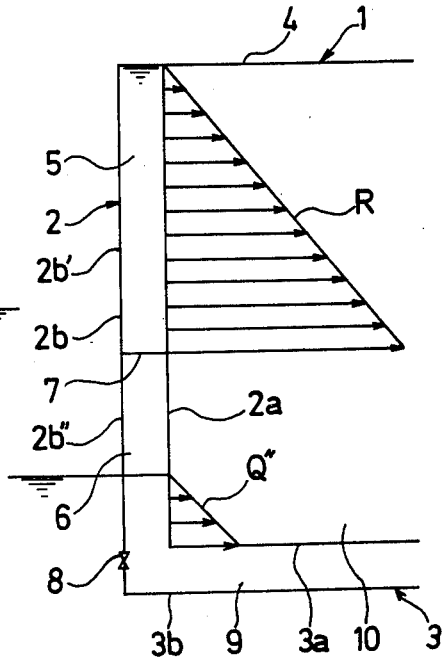

FIG. 10 shows the external-internal pressure difference as measured with the same storage tank in the light condition. In the FIG. Q″ is the external-water-pressure distribution line.

When the tank is in normal use, the valved holes 8 are kept open, allowing the external water constant access to the lower ballast tanks 6 and the bottom ballast tank 9. No force is, therefore, applied to the outer hull section 3*b* of the bottom wall 3, while the inner hull section 3*a* is subjected to only a slight external pressure because of the necessity of supporting the light weight (including the weight of the ballast in the upper ballast tank 5). Moreover, it is to be noted that the external pressure is always greater than the internal pressure on the inner hull sections 2*a* of the side walls and on the inner hull section 3*a* of the bottom wall, regardless of the loaded condition ofthe vessel.

Should the inner hull section 2*a* of one side wall 2 or the inner hull section 3*a* of the bottom wall 3 be broken for some reason to form a small hole, the ballast water in the upper ballast tank 5 or in the combined space of the lower ballast tanks 6 and the bottom ballast tank 9 will gain entrance into the tank space 10 since, as noted above, the inner hull sections 2*a*, 3*a* are always under predominant external pressure. The leak will come to a stop as soon as the difference between the pressures on both sides of the hole is reduced to naught.

Also, when such a small hole has been made by accident and ballast water in the combined space of the lower ballast tanks 6 and the bottom ballast tank 9 begins to flow into the tank space 10 through the hole, the valved holes 8 should be promptly closed. This will bring the ingress of external water to a stop.

Conversely when the liquid stored in the tank space 10 has found its way through some unintended opening into the lower ballast tanks 6 and the bottom ballast tank 9, it is again only necessary to turn the valves on the holes 8 to the closed position.

Thus, the floating liquid-storage tank of the invention is designed so that the water pressure in the double-hull structure is always higher than the liquid pressure in the tank, and therefore the liquid in the tank space is kept from intruding into the double-hull structure even if a small hole is made by accident through the inner hull. Should the liquid intrude, the further flow of the liquid out of the tank proper will be prevented by closing the valved holes 8.

Since the double-hull structure is freely accessible to the water, a great economy on steel is made possible in its fabrication as compared with the existing tanks of the type which have only double hulls of pressure-resistant construction.

An additional advantage is the anti-fire effect that the ballast water always filling the hollow of the double-hull structure exercises when the tank is used for the storage of petroleum or the like.

If the horizontal partition plates 7 are located above the intersection A, the internal pressure of the tank in the full loaded condition will exceed the external pressure, causing the outflow of the liquid from the tank in case of a break in any inner hull section 2*a*. This possibility is avoided in accordance with the present invention by the provision of the partition plates 7 at or slightly below the intersection.

What is claimed is:

1. A floating liquid-storage tank having side walls of double-hull construction for storing a liquid lighter in specific gravity than water, characterized in that the double-hull side walls consist of inner and outer hull sections and have watertight partition plates for dividing the hollows of said side walls into non-communicated upper and lower ballast tanks, said outer hull sections of said upper ballast tanks being built to be resistant to the external water pressure, and those of said lower ballast tanks being non-pressure resistant, and holes in the outer hull sections of the lower ballast tank through which the water outside can have access to the lower tanks, said partition plates being horizontally located slightly below the level of the intersection of the liquid-pressure distribution line defined by the liquid pressure within the tank when the tank is fully loaded and the external-water-pressure distribution line defined by the outside water pressure in the direction of depth of the storage tank when the tank is in the full loaded condition.

2. A liquid-storage tank according to claim 1, characterized in that said storage tank has a bottom wall of double-hull construction, and a bottom ballast tank in said bottom wall integrally with said lower ballast tanks, the outer hull section of said bottom wall being built to be non-pressure-resistant.

* * * * *